US006577052B1

(12) United States Patent
Suzuki et al.

(10) Patent No.: US 6,577,052 B1
(45) Date of Patent: Jun. 10, 2003

(54) ELECTRON GUN FOR CATHODE RAY TUBE

(75) Inventors: Nobuyuki Suzuki, Ohhara-machi (JP); Yasuo Tanaka, Ichihara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

(21) Appl. No.: 09/501,510

(22) Filed: Feb. 9, 2000

Related U.S. Application Data

(63) Continuation of application No. 09/053,053, filed on Apr. 1, 1998, now Pat. No. 6,031,326.

(30) Foreign Application Priority Data

Apr. 1, 1997 (JP) ..... 9-82524

(51) Int. Cl.[7] ..... H01J 29/48

(52) U.S. Cl. ..... 313/414; 313/477 R; 313/417; 313/412; 313/408

(58) Field of Search ..... 313/477 R, 421, 313/414, 417, 412, 426, 427, 438, 409, 441

(56) References Cited

U.S. PATENT DOCUMENTS 3,919,583 A * 11/1975 Hasker et al. ..... 313/448
4,904,898 A 2/1990 Penird et al.
5,113,112 A 5/1992 Shimoma et al.
5,162,695 A 11/1992 Shimona et al.
5,466,983 A 11/1995 Shirai et al.
5,894,190 A * 4/1999 Hirota et al. ..... 313/409

FOREIGN PATENT DOCUMENTS

| | | |
|---|---|---|
| JP | 58-31696 | 7/1983 |
| JP | 62-48653 | 3/1987 |
| JP | 62-21216 | 5/1987 |
| JP | 1-258346 | 10/1989 |
| JP | 9-231915 | 9/1997 |

* cited by examiner

*Primary Examiner*—Sandra O'Shea
*Assistant Examiner*—Anabel Ton
(74) *Attorney, Agent, or Firm*—Antonelli, Terry, Stout & Kraus, LLP

(57) ABSTRACT

A projection type cathode ray tube has a panel and an electron gun. The electron gun has a plurality of electrodes including a cathode, a control electrode, an accelerating electrode, a first anode, a focus electrode and a second anode, which electrodes are arranged in a tube axial direction at predetermined intervals. The second anode has a first cylindrical portion at the panel side and a second cylindrical portion at the cathode side, the first cylindrical portion having a larger inner dinner diameter than the inner diameter of the second cylindrical portion. The focus electrode has a panel side cylindrical portion with an inner diameter D1 and a length L1, an intermediate cylindrical portion with an inner diameter D3 and a length L3, and a cathode side cylindrical portion with an inner diameter D2 and a length L2. The inner diameters D1, D2, and D3 are different from each other. The focus electrode also has a first funnel like connecting portion between the panel side cylindrical portion and the intermediate cylindrical portion.

26 Claims, 11 Drawing Sheets

ELECTRON GUN FOR CATHODE RAY TUBE

CROSS REFERENCE TO RELATED APPLICATION

This is a continuation of U.S. application Ser. No. 09/053,053, filed Apr. 1, 1998, now U.S. Pat. No. 6,031,326, the subject matter of which is incorporated by reference herein.

BACKGROUND OF THE INVENTION

The present invention relates to a cathode ray tube and more particularly to an electron gun for a cathode ray tube whose electron lens diameter is increased, whose mass production is simplified, and which can be assembled with precision.

In a cathode ray tube, particularly a high luminance cathode ray tube, such as a projection type CRT, a high luminance, high resolution image is formed on a phosphor screen by increasing the electron beam (electric current) impinging against the phosphor screen, increasing the acceleration voltage applied to the final accelerating electrode (anode electrode) and increasing the potential of the focus electrode.

To reduce the focus distortion of the electron beam, an effort has been made to increase the diameter of the final accelerating electrode as much as possible within a range limited by the inner diameter of the neck portion of the tube envelope.

FIG. 14 is a side view showing one example of the structure of a large-diameter electron gun (hereafter referred to as an electron gun) of the type used in a conventional projection type cathode ray tube. FIG. 15 is a side view of the electron gun of FIG. 14 rotated through 90 degrees about the tube axis Z—Z. FIG. 16 illustrates a focus electrode before being assembled into the electron gun, with the upper half above the center axis of the electrode representing a cross section and the lower half representing a side view. In FIG. 14, the electron includes a first grid electrode 1 (control electrode) having a cathode therein, a second grid electrode 2 (accelerating electrode), a third grid electrode 3 (first anode), a fourth grid electrode 4 (focus electrode), a cylindrical portion 4*a* being provided on the panel side of the fourth grid electrode 4 (hereinafter referred to as a panel side portion), a cylindrical portion 4*b* being provided on the cathode side of the fourth grid electrode 4 (hereinafter referred to as a cathode side portion), an intermediate portion 4*c* of the fourth grid electrode 4, an electrode support 41 for the fourth grid electrode 4, a fifth grid electrode 5 (hereinafter referred to as a second anode or simply anode), and a bead glass 6 that insulates and supports these electrodes. Reference numbers 11, 21, 31 and 51 denote electrode supports for the first grid electrode 1, second grid electrode 2, third grid electrode 3, and fifth grid electrode 5, respectively.

In the drawing, the first grid electrode 1 to the fifth grid electrode 5 are cylindrical electrodes aligned along the tube axis, each of which has a single diameter or two or more diameters. With these electrodes aligned, a pair of softened bead glasses 6 are pressed against these electrodes from lateral directions with respect to the tube axis to embed the electrode supports 11, 21, 31, 41, 51 formed on the electrodes into the bead glasses to fix them together.

In this type of electron gun, a large diameter portion 5*a* of the fifth grid electrode 5 has a larger inner diameter than the inner diameter of the other electrodes and a small diameter portion 5*b* of the fifth grid electrode 5 has a smaller inner diameter than the inner diameters of the panel side portion 4*a* of the fourth grid electrode 4. The panel side portion 4*a* of the fourth grid electrode 4 is accommodated in the large diameter portion 5*a* of the fifth grid electrode 5, and the electrode support 51 provided at the small diameter portion 5*b* of the fifth grid electrode 5 and the electrode support 41 provided at the cathode side portion 4*b* of the fourth grid electrode 4 are embedded in the bead glass 6 to securely hold these electrodes.

The fourth grid electrode 4, as shown in FIG. 16, has the panel side portion 4*a*, the cathode side portion 4*b* and the cylindrical intermediate portion 4*c* connecting portions 4*a* and 4*b*, the three being formed integrally into one piece. The fifth grid electrode 5 and the fourth grid electrode 4 constitute an electron lens (main lens) that focuses and accelerates an electron beam produced by a cathode K accommodated in the first grid electrode 1 and which emits the focused beam toward the phosphor screen.

This type of electron gun, in which the diameter of the panel side portion 4*a* of the fourth grid electrode 4 is made larger than the diameter of the small diameter portion 5*b* of the fifth grid electrode 5, has a large effective lens diameter and therefore enables the cathode ray tube to have an excellent resolution.

The electron gun as shown in the drawing reduces the focus distortion by increasing the diameter of the main lens and increasing the length in the tube axial direction of the fourth grid electrode 4. The electrode shown in FIG. 16 allows the accuracy to be improved by connecting the intermediate portion 4*c* with the panel side portion 4*a* and the cathode side portion 4*b* of the fourth grid electrode 4, both of which have an opening end and form the electron lens.

FIG. 17 is a side view of the structure of another electron gun of the type used in a conventional projection type cathode ray tube. Like reference numerals designate the corresponding functional elements which are identical with those of FIG. 14.

In this type of electron gun, the main lens section comprises a fifth grid electrode (cylindrical second node) 5 and fourth grid electrodes (cylindrical focus electrodes) 431, 432 opposed to each other in the tube axial direction. Reference numerals 41*a* and 41*b* denote electrode supports for the divided fourth grid electrodes 431, 432.

The literature disclosing the above conventional technology includes Japanese Patent Publication No. 31696/1983, for example.

In the conventional electron guns described above, the electrode support 41 that fixes the focus electrode 4 to the bead glass 6 is secured, as by welding, to the cathode side portion 4*b* that constitutes the electron lens. Hence, when the electrode support 41 of the focus electrode 4 is embedded in the bead glass 6, the embedding force deforms the cathode side portion 4*b* of the focus electrode 4. In other words, the circular shape of the opening end of the focus electrode 4 is distorted, rendering the formation of an accurate electron lens impossible.

Reducing the embedding force to alleviate the electrode deformation when securing the electrode, however, tends to result in a reduced supporting force for the electrode and the bead glass.

In an electron gun having the construction shown in FIG. 17, the focus electrode constituting the main lens is shaped like a cylinder with a single large diameter and is long in the tube axial direction. Since the cylindrical shape of such an electrode influences the electron lens, the electrode is required to have a high precision over the entire length and is difficult to manufacture. If the cylindrical electrodes 431 and 432 of the focus electrode are formed as a single electrode, the electrode length further increases in the tube axial direction and is required to have still higher precision over the entire length. Such a long electrode is easily deformed when it is fixed or when it is transported, thus degrading the characteristics of the electron gun and therefore the image to be produced.

Another conventional electron gun is disclosed in Japanese Patent Laid-Open No. 258346/1989. In this electron gun the focus electrode has a plane surface at the cathode side end which is generally perpendicular to the electron beam and has an electron beam passage opening formed therein. For this focus electrode, however, the precision of the inner diameter of the cylindrical electrode is not taken into consideration at all, though the size of the electron beam passage opening is considered.

Japanese Patent Laid-Open No. 231915/1997 describes an electron gun in which the diameter of the focus electrode on the cathode side is made larger than the diameters of the adjacent electrodes to increase the diameter of the electron lens made up of the first anode and the focus electrode. For the focus electrode disclosed in Japanese Patent Laid-Open No. 231915/1997, however, the precision of the cylindrical portion constituting the electron lens, the ease with which the electron gun is assembled, or the precision of the assembled electron gun are not taken onto consideration at all.

The fourth grid electrode 4 has its one end inserted into the second anode and the other end opposed to the first anode. The electron beam passes through the control electrode and the accelerating electrode and is gradually expanded in diameter, after which it is subjected to focusing by the main lens and is focused on the phosphor screen. The electron beam with an expanded diameter enters the electron lens constituted by the focus electrode 4 and the first anode, and thus the electron lens is required to have high precision. To fabricate a high precision electron lens, the cylindrical portion thereof must be made with high precision.

SUMMARY OF THE INVENTION

The object of the present invention is to solve the above problems involved in the conventional technologies and to provide an electron gun for a cathode ray tube that has the advantages of being able to be assembled with high precision, of allowing mass production of high precision electrode parts, of being able to firmly support the electrodes, and of providing a high precision electron lens. To achieve the above object, the present invention provides an electron gun for a cathode ray tube, which comprises a cylindrical electrode with a large inner diameter (large-diameter cylindrical electrode); and a cylindrical electrode with a small inner diameter (small-diameter cylindrical electrode) whose panel side portion and cathode side portion are connected by an intermediate portion; wherein the panel side portion of the small-diameter cylindrical electrode is inserted into the large-diameter cylindrical electrode to constitute an electron lens and an electrode support is provided at the intermediate portion of the small-diameter cylindrical electrode.

A first aspect of the present invention concerns a cathode ray tube electron gun which comprises a plurality of electrodes including a cathode, a control electrode, a first anode, a focus electrode and second anode, all arranged at predetermined intervals in the tube axis direction; and electrode supports are provided at the sidewall of the electrodes and are embedded in an insulating support and fixed; wherein the focus electrode is cylindrical and has three different diameters at a cathode side portion, an intermediate portion and a panel side portion. The panel side portion of the focus electrode is inserted into the second anode to constitute a main lens section, the inner diameter of the intermediate portion of the focus electrode is smaller than the inner diameter of the panel side portion, but larger than the inner diameter of the cathode side portion, and the electrode support is provided at the intermediate portion of the focus electrode.

The intermediate portion of the focus electrode is longer in the tube axial direction than the cathode side portion and also the panel side portion.

Also, the inner diameter of the intermediate portion of the small-diameter cylindrical electrode is smaller than the inner diameter of the panel side portion of the small-diameter cylindrical electrode and larger than the inner diameter of the cathode side portion of the small-diameter cylindrical electrode.

Further, the inner diameter of the cathode side portion of the small-diameter cylindrical electrode is smaller than the inner diameter of the panel side portion, and the inner diameter of the intermediate portion of the small-diameter cylindrical electrode is smaller than the inner diameter of the panel side portion.

A second aspect of the invention concerns a cathode ray tube electron gun which comprises a plurality of electrodes including a cathode, a control electrode, an accelerating electrode, a first anode, a focus electrode and a second anode, all arranged at predetermined intervals in the tube axial direction; and electrode supports are provided for each electrode and are embedded in an insulating support and fixed; wherein the focus electrode extends in the tube axial direction and is cylindrical and has three different diameters at a cathode side portion, an intermediate portion and a panel side portion. The panel side portion of the focus electrode is inserted into the second anode to constitute a main lens section, and the focus electrode is divided into a first focus electrode on the first anode side and a second focus electrode on the cathode side, which are electrically connected.

With the above construction, electrode deformations produced when the electrode support is pressed against and embedded in the heated, softened bead glass during the electron gun assembly process, or electrode deformations produced when the electrode support is welded to the electrodes, are prevented from being transmitted to the panel side portion or the cathode side portion by a circular step formed at the boundary between the panel side portion or cathode side portion and the intermediate portion. This construction also facilitates the handling of electrode parts. Therefore, the precision of the panel side portion or the cathode side portion is maintained.

A third aspect of the invention concerns a cathode ray tube electron gun which comprises a plurality of electrodes including a cathode, a control electrode, an accelerating electrode, a first anode, a focus electrode and a second anode, all arranged at predetermined intervals in the tube axial direction; and electrode supports are provided at the sidewall of each electrode, and are embedded in an insulating support and fixed; wherein a final cylindrical electrode of the electron gun and the cylindrical focus electrode opposite in the tube axial direction to the final cylindrical electrode constitute a main lens section, the focus electrode having an anode side cylindrical portion on the anode side and an anode side cylindrical portion on the cathode side, and the electrode support is provided to a small-diameter portion (intermediate portion) connecting the anode side cylindrical portion and the cathode side cylindrical portion.

This construction allows the length of the cylindrical focus electrode along the tube axis to be shortened and also the areas of the electrode end portions which are required to be highly precise to be reduced. At the same time, the steps formed at the anode side portion and at the cathode side portion can absorb the deformation of the electrodes produced when the electrode support is fixed to the bead glass and when the electrode support is welded to the electrodes. Therefore, degradation of precision of the electron lens constituting section can be prevented.

In this construction, the focus electrode is divided at the intermediate portion in the tube axial direction into the first focus electrode having the anode side cylindrical portion and the second focus electrode having the cathode side cylindrical portion, the electrode supports are provided at the divided intermediate portions, and the intermediate portions are electrically interconnected.

With this construction, too, the lengths of the cylindrical focus electrodes along the tube axis can be shortened and the areas of the electrode end portions which are required to be highly precise can be reduced. Also, the steps formed at the anode side portion and the cathode side portion of each cylindrical electrode can absorb the deformation of the electrodes produced when the electrode supports are fixed to the bead glass and when the electrode supports are welded to the electrodes. Thus, degradation of precision of the electron lens constituting section can be prevented.

In this way, by providing the electrode support on the intermediate portion of the cylindrical electrode that constitutes the electron lens allows the cathode side portion and the anode side portion of the cylindrical electrode—both being an electron lens constituting section—to be shortened. This in turn makes it possible to manufacture the electron gun with high precision without deforming the cylindrical electrode, to assemble the electron gun easily and to improve the mass productivity.

The preferred embodiments of this invention will be described in detail with reference to the accompanying drawings.

DESCRIPTION OF THE PREFERRED EMBODIMENTS

First Embodiment

Figure 1:
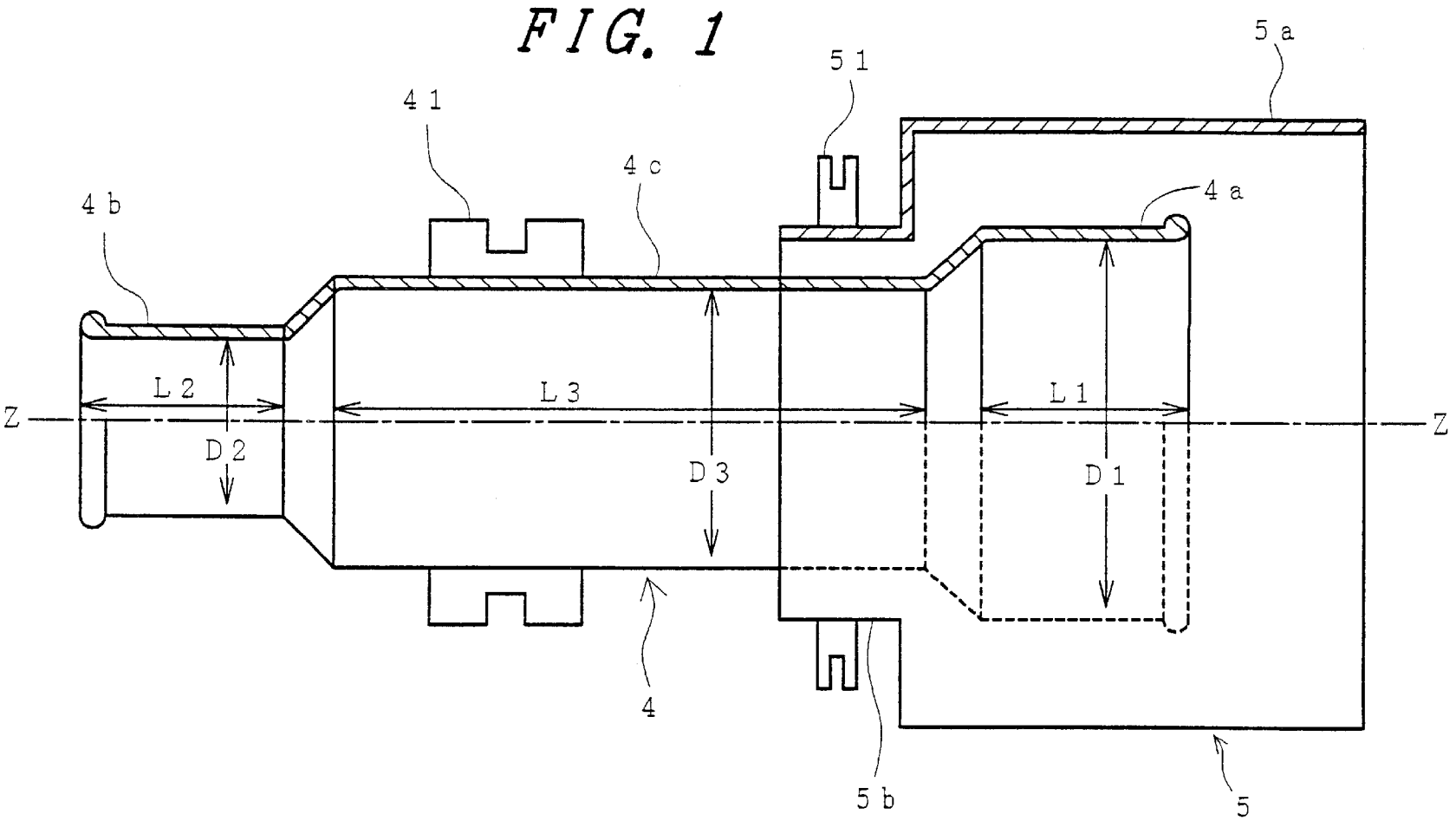
FIG. 1 is a partly cutaway side view of the cylindrical electrodes that constitute a first embodiment of the electron gun for a cathode ray tube according to this invention.

FIG. 1 is a partial cross section showing a first embodiment of a cathode ray tube electron gun according to this invention, the upper half above the center axis of the electrode being in cross section and the lower half being represented as a side view. In this first embodiment, the focus electrode is provided with steps at two locations and an electrode support is mounted on an intermediate portion that does not constitute the electron lens.

FIG. 1 of the drawing shows a focus electrode 4, which is a small-diameter cylindrical electrode, having a cylindrical portion 4*a* located on the panel side (hereinafter referred to as a panel side portion), a cylindrical portion 4*b* located on the cathode side (hereinafter referred to as a cathode side portion), and an intermediate portion located therebetween, with an electrode support 41 being provided thereon for the focus electrode 4.

In the drawing, the focus electrode 4 is fabricated by drawing as a single electrode component having the panel side portion 4*a*, the cathode side portion 4*b* and the intermediate portion 4*c*.

In this focus electrode 4, D1 denotes the inner diameter of the panel side portion 4*a* that is accommodated in the anode 5 and constitutes the main lens, and D2 designates the inner diameter of the cathode side portion 4*b* that is opposed to a cathode side electrode and constitutes the electron lens. The panel side portion 4*a* and the cathode side portion 4*b*, because they constitute respective electron lenses, are required to have high precision. An electron lens without distortion can be fabricated by making the cross section circular on a plane perpendicular to the tube axis of the cathode ray tube. D3 represents the inner diameter of the intermediate portion 4*c*, which connects the panel side portion 4*a* and the cathode side portion 4*b* and is not required to have a high precision. These diameters D1, D2, D3 have the relation D1>D3>D2.

The diameters D1, D2, D3 represent inner diameters, and the electrode plate thicknesses of the panel side portion 4*a*, the cathode side portion 4*b* and the intermediate portion 4*c* are almost equal. In FIG. 1, L1 denotes the length in the tube axial direction of the panel side portion 4*a* of the focus electrode 4, L2 denotes the axial length of the cathode side portion 4*b* of the focus electrode 4, and L3 denotes the axial length of the intermediate portion 4*c* of the focus electrode 4. The panel side portion 4*a* and the cathode side portion 4*b* each constitute an electron lens, and thus they have lengths necessary to constitute the respective electron lenses. Because the axial length L1 of the panel side portion 4*a* and the axial length L2 of the cathode side portion 4*b* are shorter than the axial length L3 of the intermediate portion 4*c*, the distortion of both opening ends of the focus electrode can be reduced. These lengths have the relations L3>L1 and L3>L2.

Elongating the axial length L3 of the intermediate portion 4*c* and shortening the axial length L1 of the panel side portion 4*a* and the axial length L2 of the cathode side portion 4*b* narrows the region where the electrode needs to be kept circular, making it possible to manufacture the focus electrode 4 with high precision and ease. The focus electrode 4 can also be manufactured with high precision and easily by extending the axial length L3 of the intermediate portion 4*c* and reducing only the axial length L2 of the cathode side portion 4*b*.

Because the electrode support 41 for fixing the focus electrode to the bead glass is welded to the intermediate portion 4*c*, deformation of the focus electrode produced when pressing the electrode support against and embedding it in the bead glass, which has been heated and softened by the electron gun assembly process, is prevented from being transmitted to the anode side portion or cathode side portion by the circular step formed at the boundary between the anode side portion or cathode side portion of the focus electrode and the intermediate portion. Thus, the precision of the anode side portion or the cathode side portion is maintained.

Figure 2:
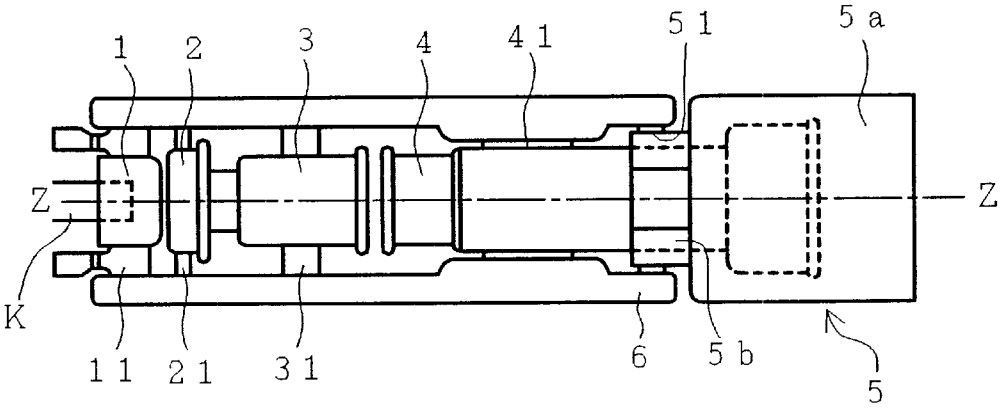
FIG. 2 is a side view showing the overall construction of the cathode ray tube electron gun of this invention.
Figure 3:
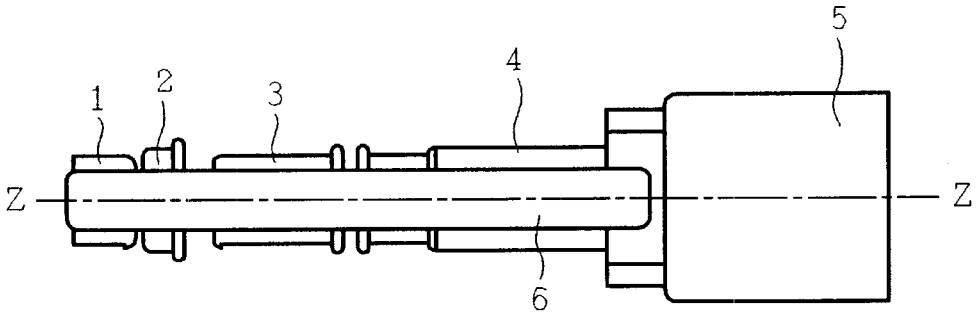
FIG. 3 is a side view of FIG. 2 rotated through 90 degrees about the tube axis Z—Z.
Figure 14:
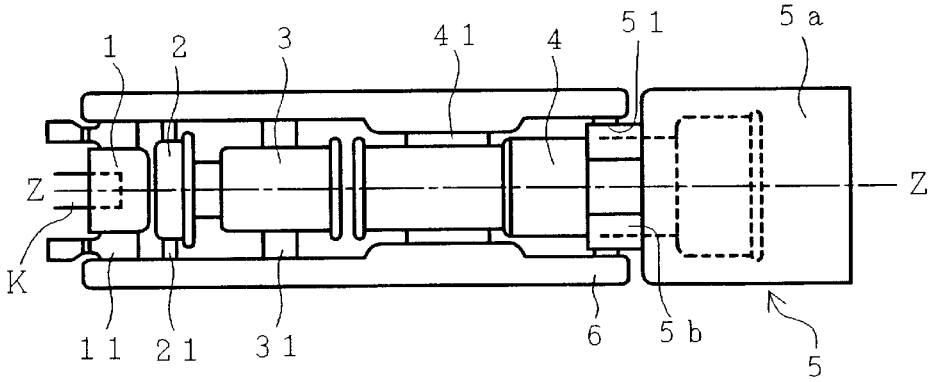
FIG. 14 (Prior art)
FIG. 14 is a side view showing an example of the structure of a large-diameter electron gun of the type used in a conventional projection type cathode ray tube.
Figure 15:
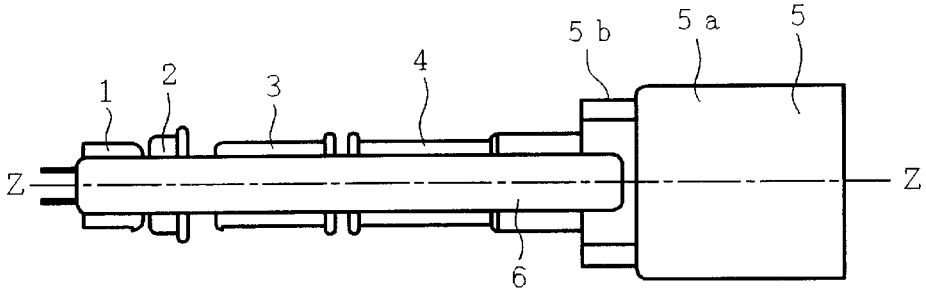
FIG. 15 (Prior art)
FIG. 15 is a side view of FIG. 14 rotated through 90 degrees about the tube axis Z—Z.
Figure 16:
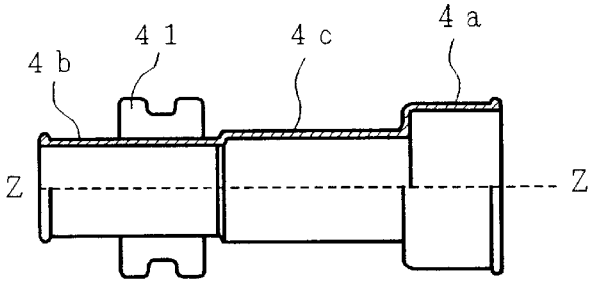
FIG. 16 (Prior art)
FIG. 16 is a partly cutaway side view showing the cylindrical electrode used in the conventional projection type cathode ray tube before being incorporated into the electron gun.

FIG. 2 is a side view showing the overall structure of the first embodiment of the cathode ray tube electron gun of this invention. FIG. 3 is a side view of FIG. 2 rotated through 90 degrees about the tube axis Z—Z. Reference numerals are assigned similarly to those of FIG. 14. That is, the electron gun includes a cathode K, a first grid electrode 1 (control electrode), second grid electrode 2 (accelerating electrode), a third grid electrode 3 (first anode), a fourth grid electrode 4 (focus electrode), an electrode support 41 for the focus electrode 4, a fifth grid electrode 5 (hereinafter referred to as a second anode or simply as an anode), and an insulating support 6 (bead glass). Reference numerals 11, 21, 31, 51 denote electrode supports for the first grid electrode, second grid electrode, third grid electrode and fifth grid electrode, respectively.

In these drawings, the first grid electrode 1 to the fifth grid electrode 5 are cylindrical or plate-like electrodes having a single diameter or two or more diameters and are aligned along the tube axis.

Figure 18:
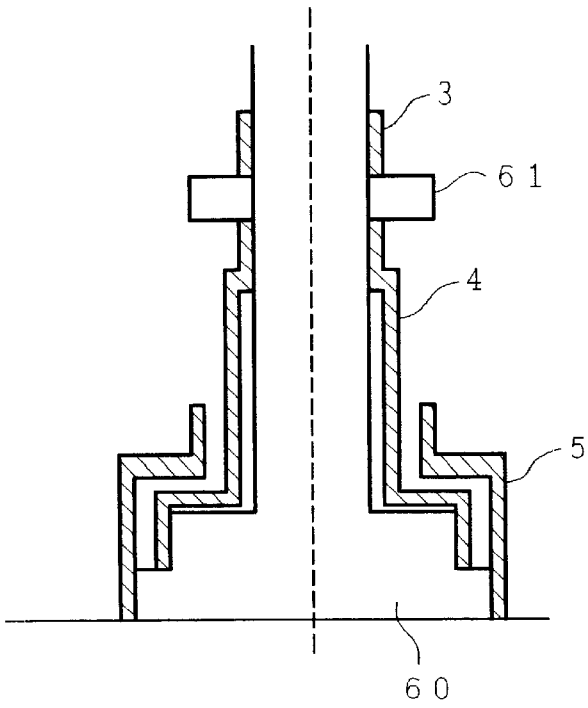
FIG. 18 is a partial cross section showing the electrodes fitted on a mount pin used to assemble the electron gun.

These electrodes, as shown in FIG. 18, are fitted on a mount pin 60 for assembly in such a way that the mount pin whose center is aligned with the center axis Z passes through the electron beam openings of the electrodes. The electrodes are assembled at predetermined intervals therebetween by stacking them successively. The anode with the largest diameter is disposed at the bottom of the mount pin. To facilitate the assembly, the assembly pin mount has decreasing diameters from the anode side toward the cathode side. Further, the mount pin 60 is formed so that the outer diameters of the mount pin 60 almost agree with a part or whole of the inner diameters of the electrodes and the center axis of the mount pin aligns with the center axes of the electrodes. That is, the alignment between the center axis of the mount pin and the center axes of the electrodes is established by the contact between the side surface of the mount pin and the inner surfaces of the electrodes.

With the electrodes aligned, a pair of softened insulating supports 6 are pressed against these electrodes from both sides, perpendicularly to the tube axis, to embed the electrode supports 11, 21, 31, 41, 51 formed on the electrodes into the insulating supports to fix them together.

In this type of electron gun, the large diameter portion 5*a* of the fifth grid electrode 5 is larger in diameter than the other electrodes, and the small diameter portion 5*b* of the fifth grid electrode 5 is smaller in diameter than the panel side portion 4*a* of the focus electrode 4. The panel side portion 4*a* of the focus electrode 4 is accommodated in the large diameter portion 5*a* of the fifth grid electrode 5, and the electrode support 51 provided at the small diameter portion 5*b* of the fifth grid electrode 5 and the electrode support 41 provided at the intermediate portion 4*c* of the focus electrode 4 are embedded in the bead glass 6 to fix them together.

At this time, the inner surfaces of the panel side portion 4*a* and the cathode side portion 4*b* of the focus electrode 4 are in contact with the side surface of the mount pin 60. This means that these contact portions need to be formed with a high accuracy. In this embodiment, because both ends of the cylindrical electrodes are coaxial with the mount pin 60, the electrodes can be arranged easily and precisely. Further, because only the ends of the cylindrical electrode are made coaxial, the region where the electrode must be fabricated with high precision is small, which in turn facilitates the manufacture of the electrode of this invention.

The focus electrode 4 described above has the construction shown in FIG. 1. With this embodiment, high precision electron guns can be mass-produced and cathode ray tubes with high image quality can be provided.

Second Embodiment

Figure 4:
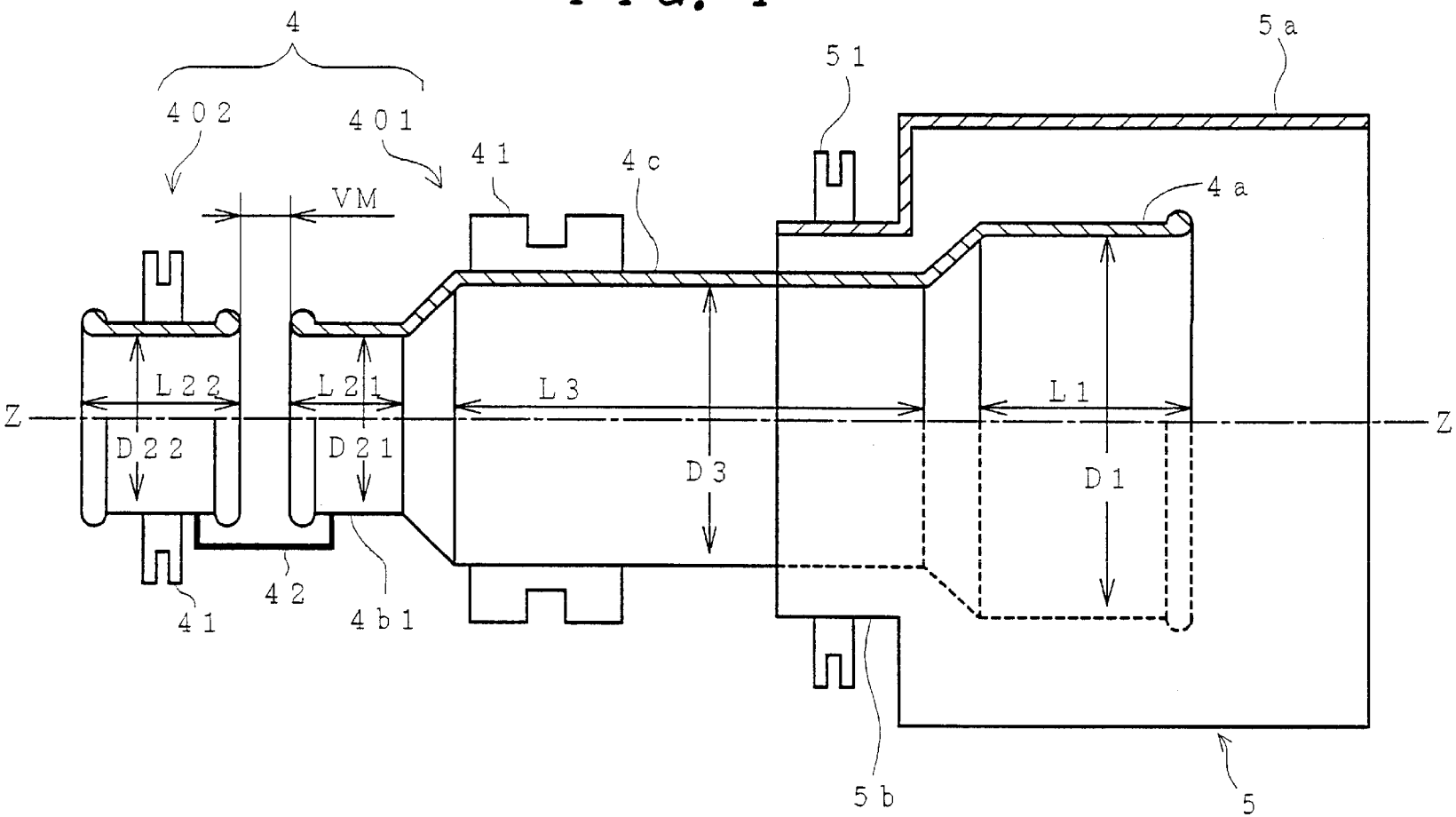
FIG. 4 is a partly cutaway side view of the cylindrical electrodes that constitute a second embodiment of the cathode ray tube electron gun according to this invention.

FIG. 4 shows a partly sectioned side view of the main lens portion of the second embodiment of the cathode ray tube electron gun of this invention, with the upper half above the center axis Z of the electrode being a sectional view and the lower half appearing as a side view. In FIG. 4, like reference numerals designate corresponding functional elements which are identical with those of FIG. 1.

The electron gun has a plurality of electrodes including a cathode, a control electrode, an accelerating electrode, a first anode, a focus electrode and a second anode, and these elements are arranged at predetermined intervals in the tube axial direction. Electrode supports, provided one to each electrode, are embedded in insulating supports to fix them together.

The focus electrode is made cylindrical in shape and extends in the tube axial direction, having three different diameters respectively provided at a cathode side portion, an intermediate portion and a panel side portion. The panel side portion of the focus electrode is inserted into the second anode to constitute the main lens section.

In the second embodiment, the focus electrode 4 is divided into a first focus electrode 401 on the anode side and a second focus electrode 402 on the cathode side, forming a gap VM at the cathode side portion 4*b*. The first focus electrode 401 is provided with steps at two locations and an electrode support at the intermediate portion where the electron lens is not provided. 4*b*1 denotes a cathode side portion of the first focus electrode 401.

The first focus electrode 401 is fabricated by drawing as a single electrode component having the panel side portion 4*a*, the cathode side portion 4*b*1 and the intermediate portion 4*c*. The second focus electrode 402 is fabricated as a single cylindrical electrode component. The focus electrode 4 is fabricated by placing the opening end of the cathode side portion 4*b*1 of the first focus electrode 401 and an opening end of the second focus electrode 402 in such a way as to be opposed to each other and then electrically connecting them by means of a connecting member 42.

The provision of the gap VM allows the electrode components (first focus electrode 401 and second focus electrode 402) to be shortened without changing the electrode length of the focus electrode 4, which in turn increases the strengths of the electrode components and reduces their deformation. Arranging a velocity modulation coil on the outer surface of the neck portion near the gap VM improves the contrast, and enables the displaying of a high quality image. In FIG. 4, L1 designates the length in the tube axial direction of the panel side portion 4*a* of the focus electrode 4; L21 indicates the axial length of the cathode side portion 4*b*1 of the first focus electrode 401; L22 indicates the axial length of the second focus electrode 402; and L3 represents the axial length of the intermediate portion 4*c* of the first focus electrode 401. The panel side portion 4*a* and the second focus electrode 402 constitute respective electron lenses and have the lengths required to constitute such electron lenses. Because the axial length L1 of the panel side portion 4*a* and the axial length L21 of the cathode side portion 4*b*1 of the first focus electrode 401 are made shorter than the axial length L3 of the intermediate portion 4*c*, the distortion of both opening ends of the focus electrode can be reduced. These lengths L1, L21, L22, L3 are in the relationship L3>L1 and L3>L21.

In this first focus electrode 401, the diameter D1 of the panel side portion 4*a* is larger than the diameter D3 of the intermediate portion 4*c*, and the diameter D21 of the cathode side portion 4*b*1 is smaller than the diameter D3 of the intermediate portion 4*c* that connects the panel side portion 4*a* and the cathode side portion 4*b*1 (D1>D3>D21).

Although, in the second focus electrode 402, the diameter D22 is equal to the diameter D21 of the cathode side portion 4*b*1 of the first focus electrode 401 (D21=D22), the diameter D22 of the second focus electrode 402 may be set so as to be smaller than the diameter D21 of the cathode side portion 4*b*1 of the first focus electrode 401 (D21>D22) according to the method of electrode gun assembly.

For example, in the cathode ray tube used in a projection type television receiver, D1 is set to 20 mm, D2 to 10 mm, D3 to 12 mm, L1 to 10 mm, L21 to 2 mm, L22 to 10 mm and L3 to 30 mm.

In assembling these focus electrodes, the inner surfaces of the panel side portion 4*a*, the cathode side portion 4*b*1 and the second focus electrode 402 are brought into engagement with the assembly mount pin 60 so that the focus electrodes can be aligned easily with the axis of the mount pin. Further, because the axial length of the intermediate portion 4*c* of the first focus electrode 401 is increased, the axial length L21 of the cathode side portion 4*b*1 can be shortened. The inner surface of the cathode side portion 4*b*1 is brought into contact with the mount pin to align the center axis of the first focus electrode 401 with the center axis of the mount pin. Hence, the cathode side portion 4*b*1 must be formed to have the same inner diameter over the entire cathode side portion so that its center axis may be aligned with the axis of the mount pin. Because the cathode side portion 4*b*1 of the first focus electrode 401 of FIG. 4 is made short, the region where the inner diameter needs to be strictly controlled is narrow, facilitating the manufacture of the electrode.

With the above embodiment, the mounting position of the electrode support 41 can be set as close to the second anode as possible considering the breakdown voltage. Thus, because the first focus electrode 401 can be made short in its overall length and the electrode support can be disposed close to the second anode, even when an external force is applied to the electron gun after manufacture, axial misalignment between the panel side portion 4*a* and the second anode 5 can be minimized. Further, since an electron lens is not formed between the first focus electrode and the second focus electrode, axial misalignment of the first focus electrode needs only to be considered with respect to the second anode 5.

The second focus electrode has a short axial length L22 and a single diameter with both ends rounded for reinforcement, is small in diameter compared with the anode side portion, and therefore is not easily deformed.

In the first focus electrode 401, the electrode support 41 is mounted on the intermediate portion 4*c*, which has a circular step between it and the anode side portion. This allows the electrode to be secured to the bead glass without deforming the panel side portion 4*a* that constitutes the electron lens. Further, since the cathode side portion 4*b*1 that requires high precision during assembly is short and the electrode support 41 is provided at the intermediate portion 4*c*, the deformation of the cathode side portion 4*b*1 can be minimized.

Third Embodiment

Figure 5:
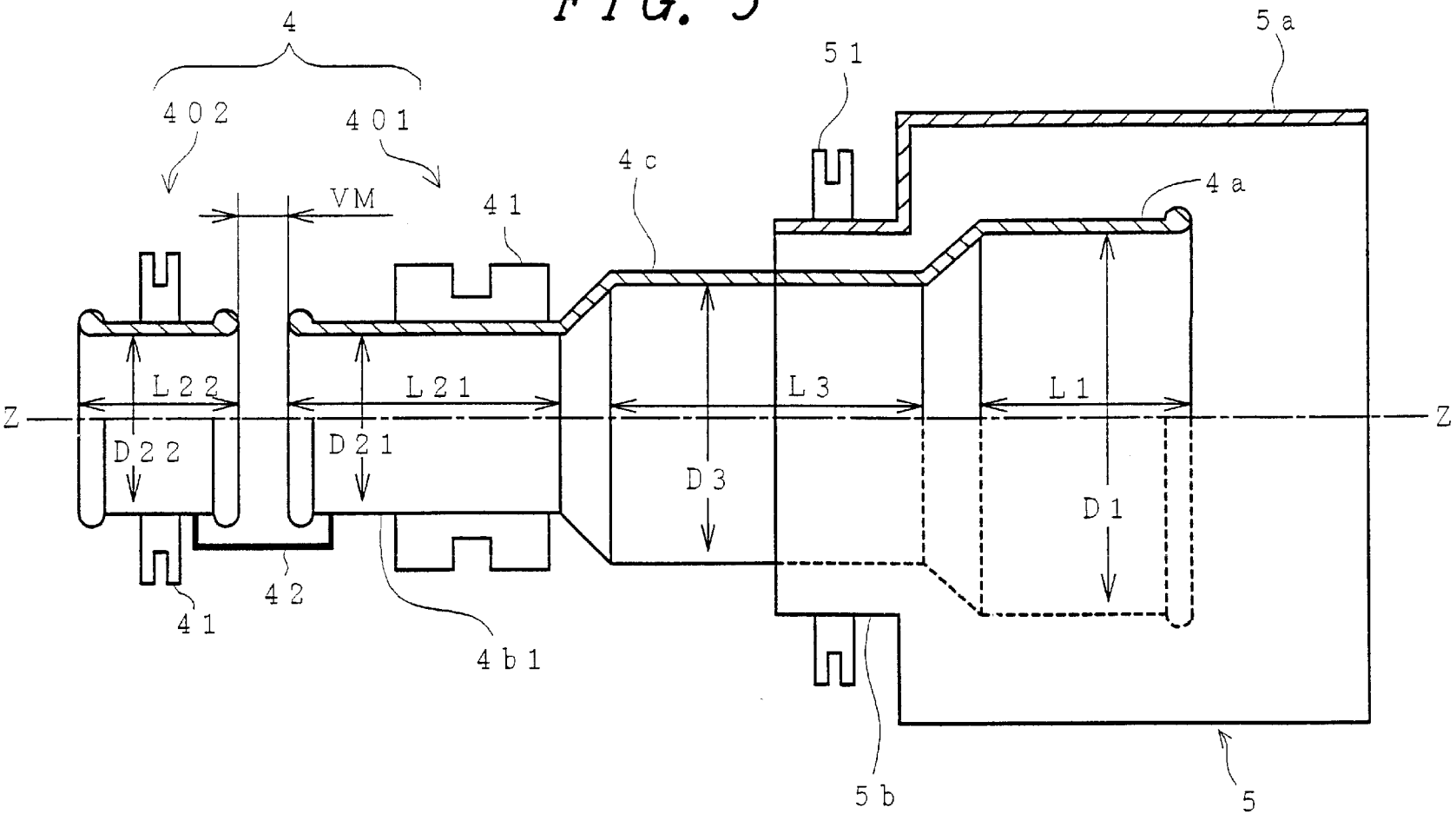
FIG. 5 is a partly cutaway side view of the cylindrical electrodes that constitute a third embodiment of the cathode ray tube electron gun according to this invention.

FIG. 5 shows a partly cross-sectioned side view of the main lens portion of the third embodiment of the cathode ray tube electron gun of this invention, with the upper half above the center axis Z of the electrode being a sectional view and the lower half appearing as a side view.

The electron gun has a cylindrical focus electrode that extends in the tube axial direction and has three different diameters respectively provided at the cathode side portion, the intermediate portion and the panel side portion. The panel side portion of the focus electrode is inserted into the second anode to constitute the main lens. In the third embodiment, the focus electrode is divided in two, the focus electrode on the anode side is provided with circular steps at two locations, and an electrode support is provided at the cathode side portion where the electron lens is not formed and which is remote from the anode, a final stage electrode.

In FIG. 5, like reference numerals denote corresponding functional elements which are identical with those of FIG. 4.

The focus electrode 4 is divided into a first focus electrode 401 on the anode side and a second focus electrode 402 on the cathode side, with a gap VM formed at the cathode side portion 4*b*. Numeral 4*b*1 denotes a cathode side portion of the first focus electrode 401.

The first focus electrode 401 is fabricated by drawing as a single electrode component which has a panel side portion 4*a*, a cathode side portion 4*b*1 and an intermediate portion 4*c*. The second focus electrode 402 is fabricated as a single cylindrical electrode component. The focus electrode 4 has the opening ends of the cathode side portion **4*b*1 of the first focus electrode 401 and of the second focus electrode 402 opposed to each other, and the cathode side portion 4*b*1 and the second focus electrode 402 are connected by means of a connecting member 42**.

The provision of the gap VM allows the electrode components (first focus electrode 401 and second focus electrode 402) to be shortened without changing the electrode length of the focus electrode 4, and so the deformation of the electrode components can be reduced. Arranging a velocity modulation coil on the outer surface of the neck portion near the gap VM improves contrast, and enables a high quality image to be displayed.

In FIG. 5, L1 designates the length in the tube axial direction of the panel side portion **4*a* of the focus electrode 4; L21 indicates the axial length of the cathode side portion 4*b*1 of the first focus electrode 401; L22 represents the axial length of the second focus electrode 402; and L3 represents the axial length of the intermediate portion 4*c* of the first focus electrode 401. The panel side portion 4*a* and the second focus electrode 402 constitute respective electron lenses and have the lengths required to constitute such electron lenses. Because the axial length L1 of the panel side portion 4*a* and the axial length L21 of the cathode side portion 4*b*1 of the first focus electrode 401 are set shorter than the axial length L3 of the intermediate portion 4*c*, the distortion of both opening ends of the focus electrode can be reduced. These lengths L1, L21, L22, L3 are in the relationship L3>L1 and L3>L21**.

In this first focus electrode 401, the inner diameter D1 of the panel side portion **4*a* is larger than the inner diameter D3 of the intermediate portion 4*c*, and the inner diameter D21 of the cathode side portion 4*b* is smaller than the inner diameter D3 of the intermediate portion 4*c* that connects the panel side portion 4*a* and the cathode side portion 4*b* (D1>D3>D21**).

Although the inner diameter D22 of the second focus electrode 402 is equal to the inner diameter D21 of the cathode side portion **4*b*1 of the first focus electrode 401 (D21=D22), the inner diameter D22 of the second focus electrode 402 may be set so as to be smaller than the inner diameter D21 of the cathode side portion 4*b*1 of the first focus electrode 401 according to the method of electrode gun assembly (D21>D22**).

For example, in the cathode ray tube used in a projection type television receiver, D1 is set to 20 mm, D2 to 10 mn D3 to 12 mm, L1 to 10 mm, L21 to 10 mm, L22 to 10 mm and L3 to 22 mm.

In the first focus electrode 401, the electrode support 41 is mounted on the cathode side portion **4*b*1, with two circular steps being interposed between the cathode side portion 4*b*1** and the panel side portion, so that the electrode can be secured to the bead glass without deforming the anode side portion that constitutes the main lens.

Further, by arranging the electrode support 41 on the cathode side portion **4*b*1 close to the intermediate portion 4*c* (close to the step), it is possible to minimize the deformation of the first focus electrode 401**.

Normally, the open ends of the electrodes are rounded so as to prevent discharge and to reinforce the electrodes. In such an electron gun, however, the open end of the anode is not rounded and so there is a possibility of discharge. In the case of this embodiment, because the electrode support 41 is positioned remote from the anode, which has the highest voltage, discharge between the anode 5 and the focus electrode 4 can be prevented.

The second focus electrode 402 is not easily deformed because it has a short axial length L22 and a single diameter with both ends rounded for reinforcement, and the diameter is smaller than that of the anode side portion.

Fourth Embodiment

Figure 6:
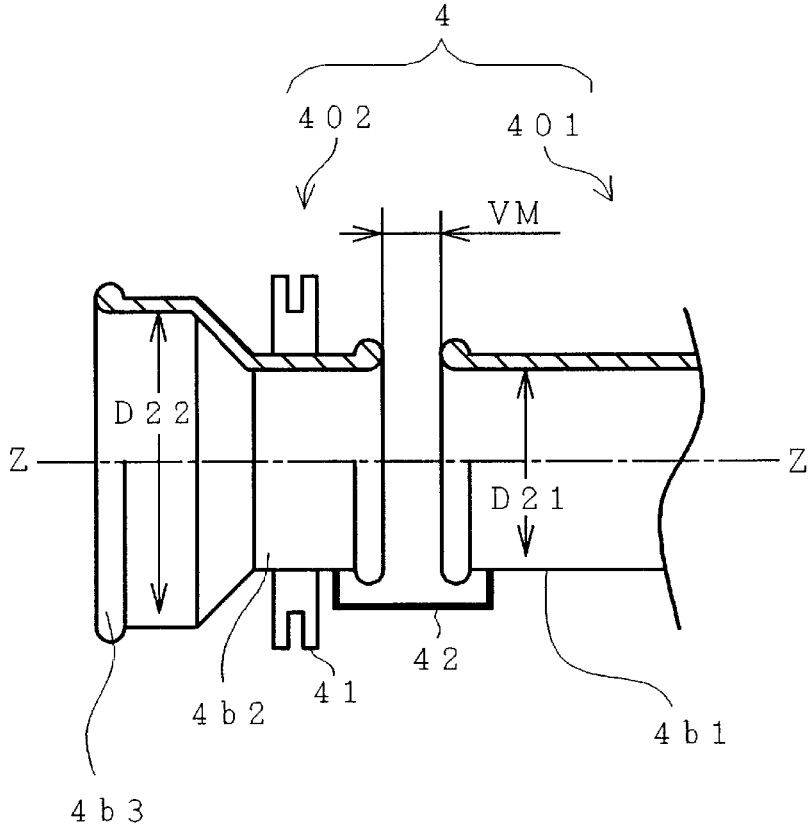
FIG. 6 is a partly cutaway side view of the cylindrical electrodes that constitute a fourth embodiment of the cathode ray tube electron gun according to this invention.

FIG. 6 is a partly cross-sectioned side view of the focus electrode of the fourth embodiment of the cathode ray tube electron gun of this invention, with the upper half above the center axis Z of the electrode being a sectional view and the lower half appearing as a side view. In the fourth embodiment, the focus electrode is divided in two, a step is provided to the cathode side focus electrode, and an electrode support is provided on the cathode side portion where the electron lens is not formed. In FIG. 6, like reference numerals denote corresponding functional elements which are identical with those of FIG. 1.

The focus electrode 4 is divided into a first focus electrode 401 on the anode side and a second focus electrode 402 on the cathode side, with a gap VM at the cathode side portion **4*b*. Numeral 4*b*1 denotes a cathode side portion of the first focus electrode 401, and 4*b*2 denotes a small-diameter portion (cathode side portion) of the second focus electrode 402**.

The second focus electrode 402 is fabricated by drawing as a single electrode component, which has a large-diameter portion **4*b*3 and a small-diameter portion 4*b*2. The focus electrode 4 has the opening ends of the cathode side portion 4*b*1 of the first focus electrode 401 and of the small-diameter portion 4*b*2 of the second focus electrode 402 opposed to each other, and the cathode side portion 4*b*1 and the small-diameter portion 4*b*2 are connected by means of a connecting member 42**.

The provision of the gap VM allows the electrode components (first focus electrode 401 and second focus electrode 402) to be shortened without changing the electrode length of the focus electrode 4, so that the deformation of the electrode components can be reduced. Arranging a velocity modulation coil on the outer surface of the neck portion near the gap VM improves the contrast, producing a high quality image.

In the second focus electrode 402 of FIG. 6, although the diameter of the small-diameter portion **4*b* 2 is equal to the diameter of the cathode side portion 4*b*1 of the first focus electrode 401, the diameter of the small-diameter portion 4*b*2 of the second focus electrode 402 may be smaller than the diameter of the cathode side portion 4*b*1 of the first focus electrode 401** according to the method of electrode gun assembly.

Further, the second focus electrode 402 has the large-diameter portion **4*b*3 on the cathode side. The large-diameter portion 4*b*3 and an electrode (not shown) situated on the cathode side, and opposed to the large-diameter portion 4*b*3, constitute the electron lens. To increase the diameter of the electron lens, the diameter D22 of the large-diameter portion 4*b*3 of the second focus electrode 402 is set so as to be larger than the diameter of the small-diameter portion 4*b*2**.

The second focus electrode 402 has the electrode support 41 installed on the small-diameter portion **4*b*2 with a circular step formed between it and the large-diameter portion 4*b*3, so that the electrode can be secured to the bead glass without deforming the large-diameter portion 4*b*3** that constitutes the electron lens.

The features of this embodiment can be applied to the second or third embodiment to produce the combined effects of the respective embodiments. It is also possible to apply the features of this embodiment to the first embodiment.

Fifth Embodiment

Figure 7:
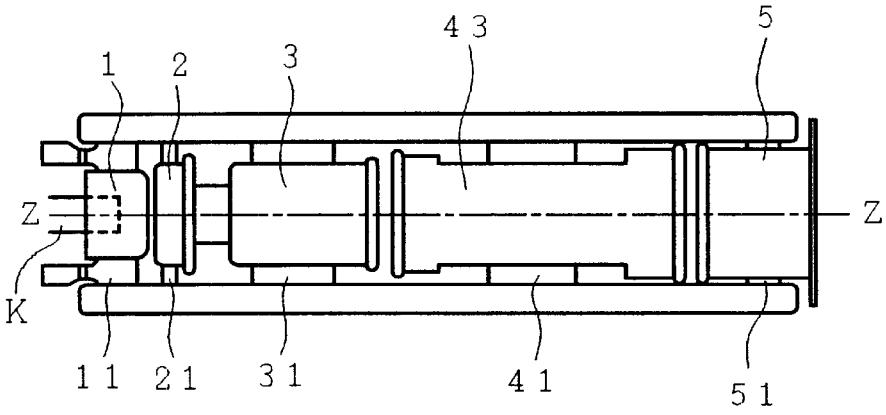
FIG. 7 is a side view showing the overall construction of the cathode ray tube electron gun having a modified configuration according to this invention.
Figure 17:
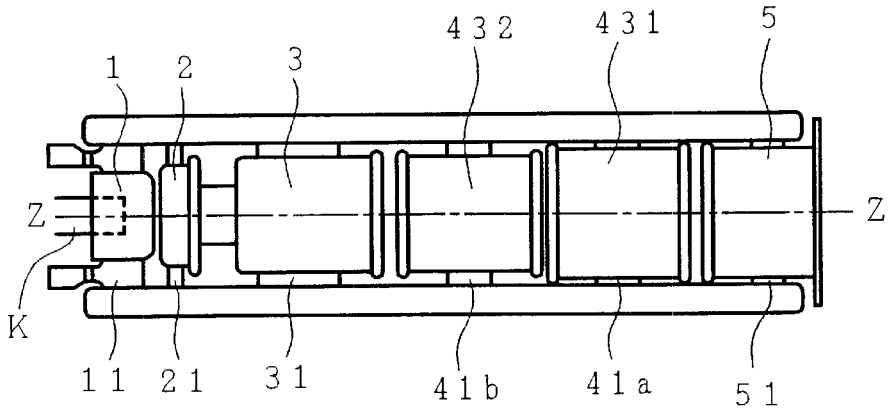
FIG. 17 (Prior art)
FIG. 17 is a side view showing another example of the structure of an electron gun of the type used in a conventional projection type cathode ray tube.

FIG. 7 is a side view showing the overall construction of the fifth embodiment of the cathode ray tube electron gun of this invention. The electron gun has a cathode K, a first grid electrode 1 (control electrode), a second grid electrode 2 (accelerating electrode), a third grid electrode 3 (a first anode), a fourth grid electrode 43 (focus electrode), an electrode support 41 for the focus electrode 43, a fifth grid electrode 5 (second anode) or final electrode, and an insulating support 6 (bead glass). Reference numerals 11, 21, 31, 51 denote electrode supports for the first grid electrode 1, second grid electrode 2, third grid electrode 3, and fifth grid electrode 5, respectively. Like reference numerals designate corresponding functional elements which are identical with those of FIG. 17. The main lens section comprises the fifth grid electrode (cylindrical second anode) 5 and the fourth grid electrode (cylindrical focus electrode) 43, which is axially opposed to the fifth grid electrode 5.

In the drawing, the first grid electrode 1 to the fifth grid electrode 5 are cylindrical or plate-like electrodes with a single diameter or two or more diameters and are aligned along the tube axis. With the electrodes axially aligned, a pair of softened insulating supports 6 are pressed against the electrodes from both sides perpendicularly to the tube axis to embed the electrode supports 11, 21, 31, 41, 51 formed on the electrodes into the insulating supports to fix them together.

Figure 8:
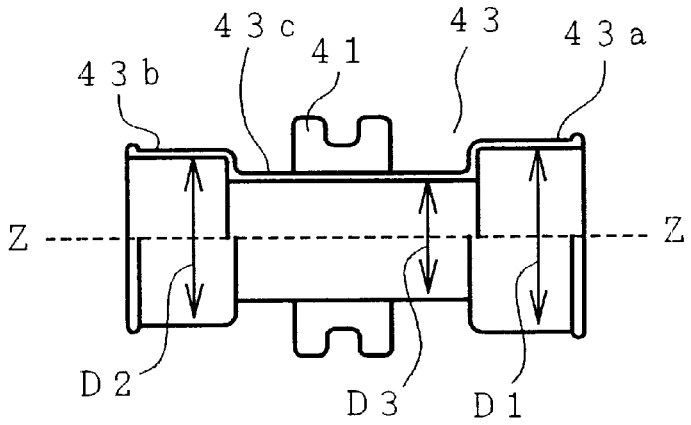
FIG. 8 is a partly cutaway side view of the cylindrical electrode that constitute a fifth embodiment of the cathode ray tube electron gun according to this invention.

FIG. 8 is a partly cross-sectioned side view of the fifth embodiment of an electrode according to this invention, as used in a cathode ray tube electron gun, with the upper half above the center axis of the electrode being a sectional view and the lower half appearing as a side view.

In the drawing, the focus electrode 43 includes an anode side cylindrical portion 43a formed at the end of the focus electrode 43 facing the final electrode (second anode), a cathode side cylindrical portion 43*b* formed at the end of the focus electrode 43 facing the third grid electrode, an intermediate portion 43*c* an electrode support 41 is mounted. The focus electrode 43 is manufactured as a single electrode component having the anode side cylindrical portion 43*a*, the cathode side cylindrical portion 43*b* and the intermediate portion 43*c*.

In the focus electrode 43 of this embodiment, the diameter D1 of the anode side cylindrical portion 43*a* is greater than the diameter D2 of the cathode side cylindrical portion 43*b*, and the diameter D3 of the intermediate portion 43*c* that connects the anode side cylindrical portion 43*a* and the cathode side cylindrical portion 43*b* is smaller than the diameters of the anode side cylindrical portion 43*a* and the cathode side cylindrical portion 43*b* (D1>D2>D3). The diameter D1 of the anode side cylindrical portion 43*a* and the diameter D2 of the cathode side cylindrical portion 43*b* may be set so as to be equal (D1=D2>D3).

The anode side cylindrical portion 43*a* is opposed to the fifth grid electrode 5 described with reference to FIG. 7 to constitute the main lens. While the anode side cylindrical portion 43*a* and the cathode side cylindrical portion 43*b* need to be fabricated with high precision, the intermediate portion 43*c* does not need to be fabricated with high precision since it merely has the function of connecting the anode side cylindrical portion 43*a* and the cathode side cylindrical portion 43*b*.

The manufacture with high precision of the focus electrode 43 that constitutes the main lens can be made easy by increasing the axial length of the intermediate portion 43*c* and shortening the axial lengths of the anode side cylindrical portion 43*a* and the cathode side cylindrical portion 43*b*.

The electrode support 41 for fixing the focus electrode 43 to the bead glass is welded to the intermediate portion 43*c*. With this construction, the deformation of the electrode produced when the electrode support 41 is pressed against and embedded in the heated, softened bead glass during the process of electron gun assembling can be prevented from affecting the anode side cylindrical portion 43*a* or the cathode side cylindrical portion 43*b* by the step formed at the boundary between the anode side cylindrical portion 43*a*, or cathode side cylindrical portion 43*b*, and the intermediate portion 43*c*. Thus, the precision of the anode side cylindrical portion 43*a* or cathode side cylindrical portion 43*b* can be maintained.

In the case of this embodiment, too, high precision electron guns can be manufactured with high mass productivity and cathode ray tubes with high image quality can be provided.

Sixth Embodiment

Figure 9:
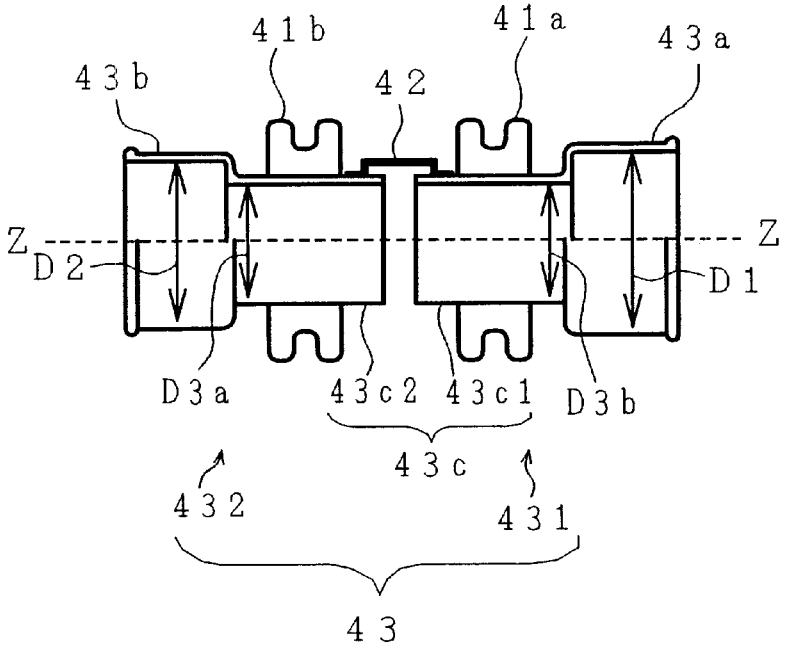
FIG. 9 is a partly cutaway side view of the cylindrical electrodes that constitute a sixth embodiment of the cathode ray tube electron gun according this invention.

FIG. 9 is a partly cross-sectioned side view of a focus electrode making up the sixth embodiment of the cathode ray tube electron gun of this invention. This focus electrode is applied to the electron gun having the construction shown in FIG. 7.

In the drawing, elements having the same functions as those shown in FIG. 8 are assigned like reference numerals. The focus electrode 43 is divided into a first focus electrode 431 having an anode side cylindrical portion 43*a* opposed to the anode 5 and a second focus electrode 432 having a cathode side cylindrical portion 43*b* opposed to the third grid electrode 3. The focus electrode 43 has an intermediate portion 43*c* including a first intermediate portion 43*c*1 joined to the anode side cylindrical portion 43*a* and a second intermediate portion 43*c*2 joined to the cathode side cylindrical portion 43*b*, an electrode support 41*a* mounted on the first intermediate portion 43*c*1, an electrode support 41*b* mounted on the second intermediate portion 43*c*2, and a connecting member 42 for electrically connecting the first focus electrode 431 and the second focus electrode 432.

In the focus electrode 43 as shown, the anode side cylindrical portion 43*a* and the first intermediate portion 43*c*1 are formed into a single electrode component, the cathode side cylindrical portion 43*b* and the second intermediate portion 43*c*2 are formed into a single electrode component, and the first intermediate portion 43*c*1 and the second intermediate portion 43*c*2 are opposed to each other at their opening ends and electrically interconnected by the connecting member 42.

In this focus electrode 43, the diameter D1 of the anode side cylindrical portion 43*a* is larger than the diameter D2 of the cathode side cylindrical portion 43*b*, and the diameters D3*a* and D3*b* of the first intermediate portion 43*c*1 and the second intermediate portion 43*c*2 are smaller than the diameters of the anode side cylindrical portion 43*a* and the cathode side cylindrical portion 43*b* (D1>D2>D3*a*, D3*b*). The diameter D1 of the anode side cylindrical portion 43*a* and the diameter D2 of the cathode side cylindrical portion 43*b* may be set as to be equal (D1=D2>D3*a*, D3*b*).

The anode side cylindrical portion 43*a* is opposed to the anode 5 of the electron gun described with reference to FIG. 7, constituting the main lens. While the anode side cylindrical portion 43*a* and the cathode side cylindrical portion 43*b* facing the electrode on the cathode side are required to be fabricated with high precision, the first intermediate portion 43*c*1 and the second intermediate portion 43*c*2 do not need to be fabricated with high precision since they merely have the function of connecting the anode side cylindrical portion 43*a* and the cathode side cylindrical portion 43*b*.

Because only one step is formed in each of the first focus electrode 431 and the second focus electrode 432, these focus electrodes can be fabricated easily. Further, if the first focus electrode 431 and the second focus electrode 432 are made in the same shape, the focus electrode 43 can be mass-produced easily.

By increasing the axial lengths of the first intermediate portion 43*c*1 and the second intermediate portion 43*c*2 and shortening the anode side cylindrical portion 43*a* and the cathode side cylindrical portion 43*b*, the deformation of the anode side cylindrical portion 43*a* and the cathode side cylindrical portion 43*b* can be minimized, allowing the high precision focus electrode 43 to be manufactured easily. Because the electrode supports 41*a*, 41*b* for fixing the electrodes to the bead glass are welded to the first intermediate portion 43*c*1 and the second intermediate portion 43*c*2 and are securely embedded in the bead glass, the deformation of the electrodes produced when the electrode supports 41*a*, 41*b* are pressed against and embedded in the heated, softened bead glass during the process of electron gun assembling can be prevented from affecting the anode side cylindrical portion 43*a* or the cathode side cylindrical portion 43*b* because of the steps formed at the boundary between the anode side cylindrical portion 43*a* or cathode side cylindrical portion 43*b* and the first intermediate portion 43*c*1 or the second intermediate portion 43*c*2. Thus, the precision of the anode side cylindrical portion 43*a* and cathode side cylindrical portion 43*b* affecting the lens accuracy can be maintained.

In this embodiment, too, high precision electron guns can be mass-produced and cathode ray tubes with high image quality can be provided.

Figure 10:
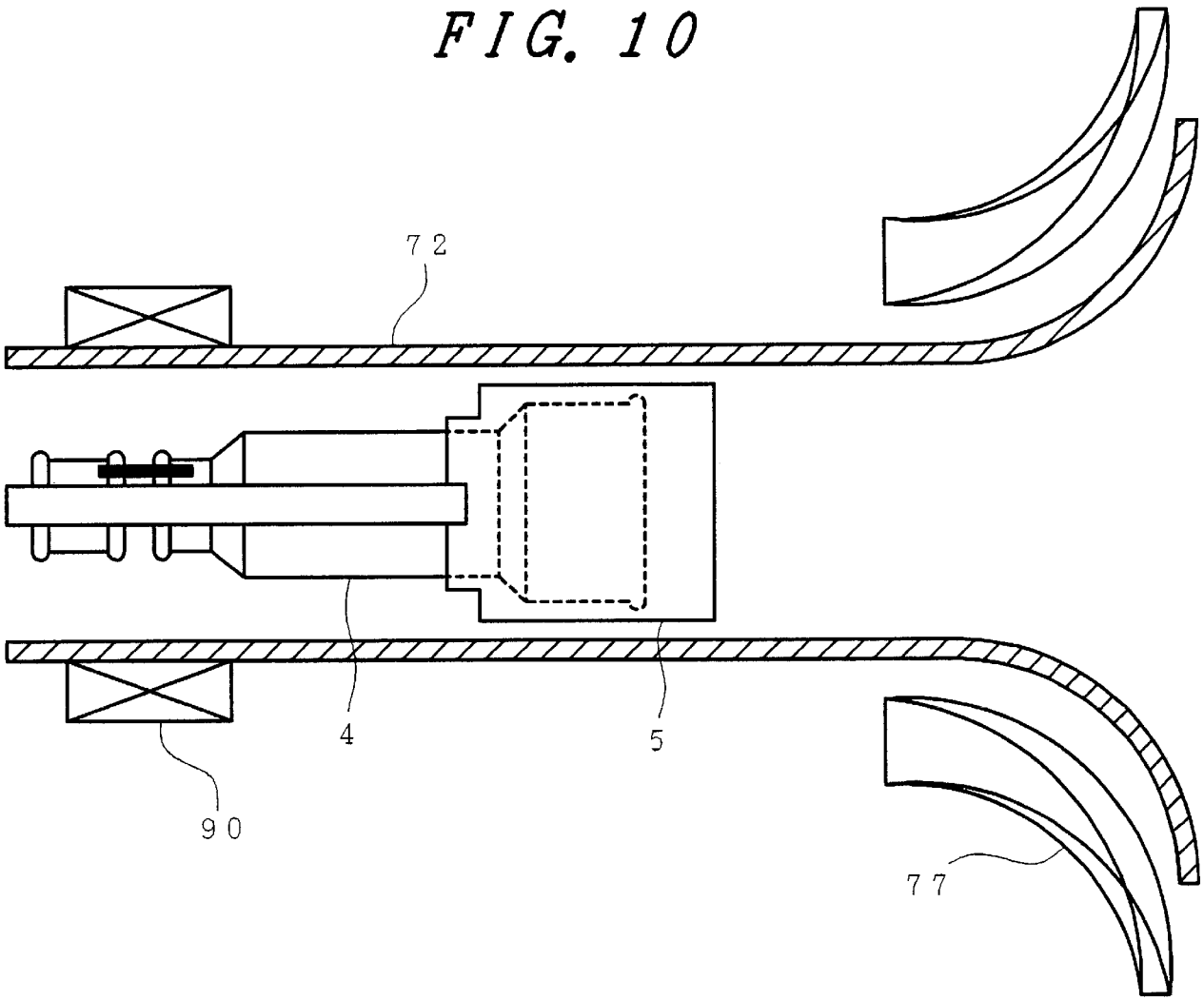
FIG. 10 is a cross section of a neck portion of the cathode ray tube where the cathode ray tube electron gun of this invention is accommodated.

FIG. 10 shows the electron gun using the electrodes with the gap VM, such as illustrated in FIGS. 4, 5, 6 and 9, which are installed in the neck portion of a cathode ray tube. A velocity modulation coil 90 is disposed on the outside of the neck portion at a location corresponding to the gap VM. The velocity modulation coil 90 operates to improve the contrast by changing the scan velocity of the electron beam. Among the literature disclosing such a feature is Japanese Patent Publication No. 21216/1987.

The focus electrode of the above embodiment is long in the tube axial direction. Hence, reducing its axial length by providing the gap VM can prevent a deformation of the electrode. The velocity modulation coil 90 disposed on the outer surface of the neck portion near the gap VM provides high contrast and therefore a high quality image. Aligning the center of the gap VM with the center of the velocity modulation coil 90 enables the electron beam to be efficiently subjected to the action of the velocity modulation coil 90.

Figure 11:
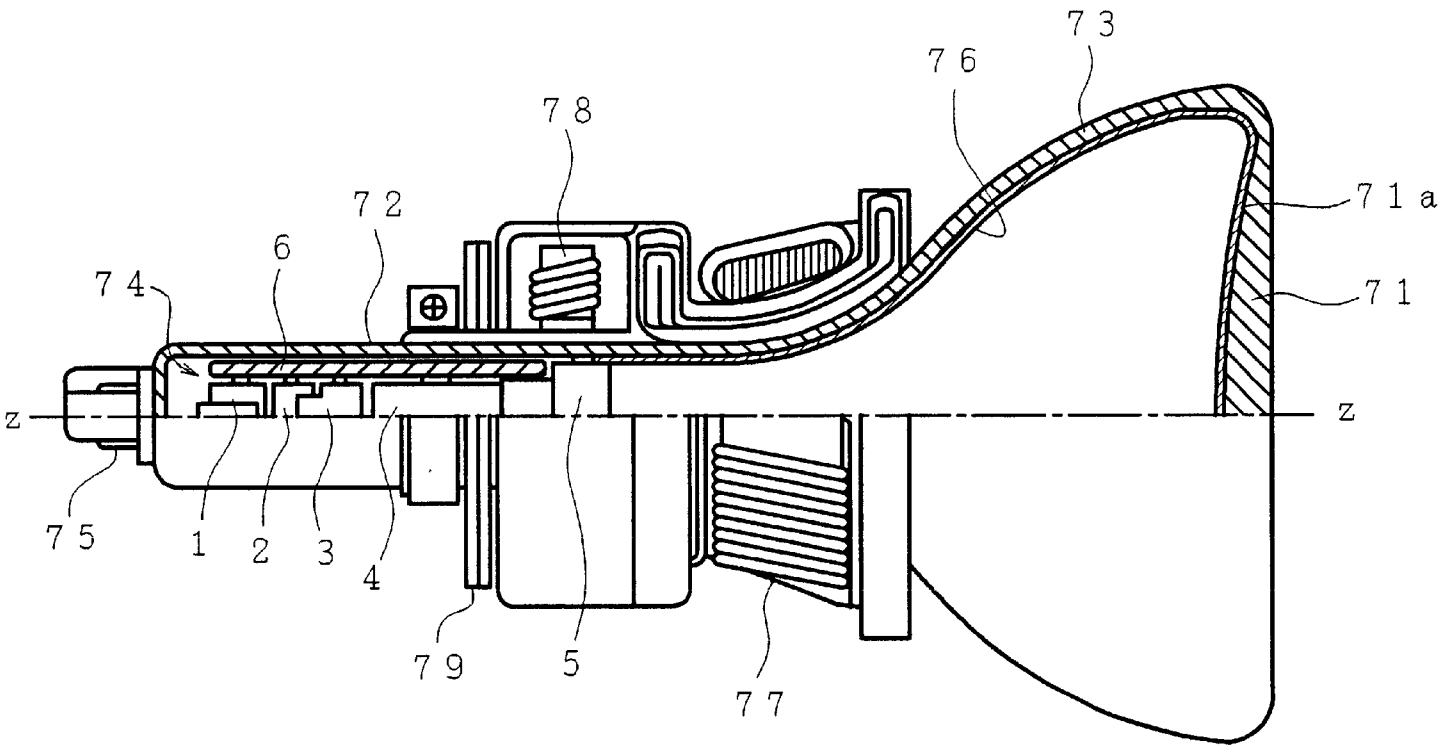
FIG. 11 is a partial cross section of a projection type cathode ray tube, showing an example of the structure of a cathode ray tube using the electron gun of this invention.

FIG. 11 is a partly cross-sectioned side view of a projection type cathode ray tube, for illustrating the construction of the cathode ray tube using an electron gun according to this invention. The cathode ray tube includes a panel portion 71, a fluorescent layer 71*a*, a neck portion 72, a funnel portion 73, an electron gun 74, a stem 75, an internal conductive layer 76, a deflection yoke 77, a convergence coil 78, and a centering adjust magnet 79. Like reference numbers denote corresponding elements in FIG. 1.

In the drawing, the fluorescent layer 71*a* is formed on the inner surface of the panel portion 71 and the electron gun is installed in the neck portion 72. An anode voltage is applied to the electron gun 74 from the internal conductive layer 76, and voltages and video signals from pins led out to the stem 75 are supplied to the electron gun 74. The electron beam emitted from the electron gun 74 is deflected by the magnetic field of the deflection yoke 77 to scan the fluorescent layer 71*a* and reproduce an image. By using this cathode ray tube, a high quality image reproduced on the panel portion 71 can be projected onto a screen not shown to reproduce the image.

Figure 12:
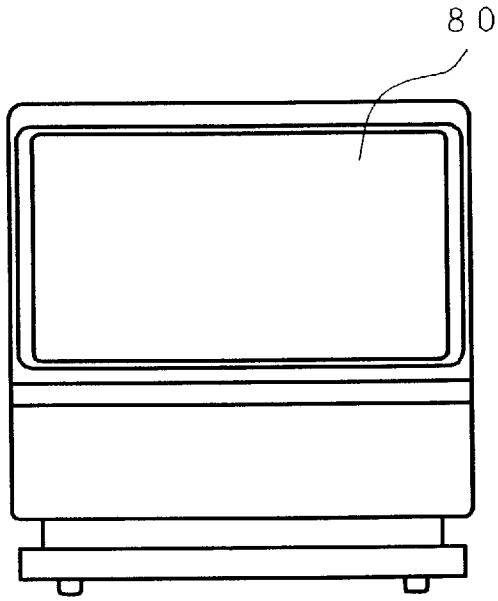
FIG. 12 is a front view showing an example of a projection type television receiver that uses a cathode ray tube in which the electron gun of this invention is incorporated.
Figure 13:
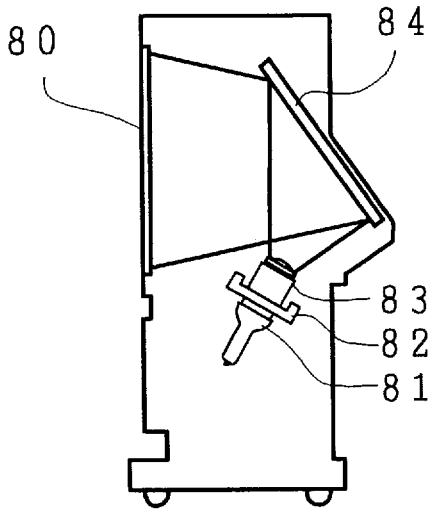
FIG. 13 is a schematic cross section showing the internal structure of the projection type television receiver of FIG. 12.

FIG. 12 is a front view of one example of a projection type television receiver that uses a cathode ray tube in which an electron gun according to this invention is incorporated. FIG. 13 is a schematic cross section showing an example of the internal structure of the projection type television receiver of FIG. 12. As shown in FIG. 12 and FIG. 13, the image formed on the panel portion of the projection type cathode ray tube 81 is magnified by a projection optical system 83, which is installed on the panel portion through a connector 82, and the image is then projected through a mirror 84 onto a screen 80. Such a projection type television receiver can reproduce an image on a large screen of 40 inches or larger with a high image quality.

For the foregoing embodiments, the focus electrode 43 and the anode 5, both of which are required to be fabricated with the highest precision, have been mainly described.

FIG. 18 is a partly cross-sectioned view showing the focus electrode and its vicinity when the elements are being assembled into an electron gun. On a mount pin 60 used in assembling the electron gun, there is a spacer 61 to determine the interval between electrodes, and a focus electrode 4, a second anode 5, mounted with the center axis Z of the electrodes coincident with the axis of the mount pin 60, whereby the electrodes are assembled so that the center axis of the mount pin 60 and the center axis of each electrode are aligned. The diameter of the mount pin 60 is the largest near the second anode and decreases stepwise toward the cathode side. The inner surface of the electrodes and the outer surface of the mount pin are made nearly equal to align their center axes. By applying the focus electrode of the above embodiments to the electron gun assembly method shown in FIG. 18, an electron gun with high accuracy can be fabricated easily.

The electron beam, while passing through the control electrode and the accelerating electrode, is increased in its diameter. The electron beam having a large diameter enters the electron lens constituted of the focus electrode 4 and the first anode. Then, the focusing function of the main lens will act on the increased diameter of the electron beam to focus the beam on the fluorescent layer. Hence, the electron lens made up of the focus electrode 4 and the first anode is required to be fabricated with high precision. A high precision electron lens can be formed in accordance with this invention.

According to this invention, the focus electrode that constitutes the main lens of the electron gun has, between the large-diameter portion and the small-diameter portion, an intermediate portion which is not required to be so highly precise. The intermediate portion is made longer than the large-diameter portion and the small-diameter portion, an electrode support to be embedded in and secured to the insulating support is mounted to the intermediate portion, and the intermediate portion is connected to ends of the cylindrical electrodes which are axially opposed to the other electrode. This arrangement suppresses deformation of the electron lens (main lens) constituting section during assembling of the electron gun as well as degradation of the focusing characteristic of the electron beam and also facilitates the assembling work. The invention therefore can realize a cathode ray tube electron gun with a main lens which has high mass productivity and high precision. It is also possible to minimize the distortion of the electron lens constituting section produced when the bead supports are mounted to the electrodes.

What is claimed is:

1. A projection type cathode ray tube comprising:

a panel; and an electron gun;

wherein said electron gun has a plurality of electrodes including a cathode, a control electrode, an accelerating electrode, a first anode, a focus electrode and a second anode, which electrodes are arranged in a tube axial direction at predetermined intervals, and said second anode having a first cylindrical portion at a panel side and a second cylindrical portion at a cathode side, said first cylindrical portion having a larger inner diameter than an inner diameter of said second cylindrical portion, said focus electrode having a panel side cylindrical portion with an inner diameter D1 and a length L1, an intermediate cylindrical portion with an inner diameter D3 and a length L3, a cathode side cylindrical portion with an inner diameter D2 and a length L2, said inner diameters D1, D2, and D3 being different from each other, and said length L3 being larger than said length L2, and said focus electrode having a first funnel like connecting portion between said panel side cylindrical portion and said intermediate cylindrical portion.

2. A projection type cathode ray tube according to claim 1, wherein said second anode has a connecting portion between said first cylindrical portion and said second cylindrical portion, and a connecting position between said first funnel like connecting portion and said intermediate cylindrical portion of said focus electrode is nearer to said panel as compared to said connecting portion of said second anode.

3. A projection type cathode ray tube according to claim 2, wherein a length along said tube axial direction of said first funnel like connecting portion is substantially larger than a thickness of a cylindrical wall of said focus electrode.

4. A projection type cathode ray tube according to claim 2, wherein a cross section along said tube axial direction of said first funnel like connecting portion of said focus electrode has a tapered line beveled to a wall of said panel side cylindrical portion and a wall of said intermediate cylindrical portion.

5. A projection type cathode ray tube according to claim 2, wherein said inner diameters D1, D2, and D3 satisfies D1>D3>D2.

6. A projection type cathode ray tube according to claim 1, wherein said focus electrode has a second funnel like connecting portion between said intermediate cylindrical portion and said cathode side cylindrical portion.

7. A projection type cathode ray tube according to claim 6, wherein said second anode has a connecting portion between said first cylindrical portion and said second cylindrical portion, wherein a connecting position between said first funnel like connecting portion and said intermediate cylindrical portion of said focus electrode is nearer to said panel as compared to said connecting portion of said second anode.

8. A projection type cathode ray tube according to claim 7, wherein a length along said tube axial direction of said second funnel like connecting portion is substantially larger than a thickness of a cylindrical wall of said focus electrode.

9. A projection type cathode ray tube according to claim 7, wherein a cross section along said tube axial direction of said second funnel like connecting portion of said focus electrode has a tapered line beveled to a wall of said intermediate, cylindrical portion and a wall of said cathode side cylindrical portion.

10. A projection type cathode ray tube according to claim 7, wherein said inner diameters D1, D2, and D3 satisfies D1>D3>D2.

11. A projection type cathode ray tube comprising:

a panel; and an electron gun;

wherein said electron gun has a plurality of electrodes including a cathode, a control electrode, an accelerating electrode, a first anode, a focus electrode and a second anode, which electrodes are arranged in a tube axial direction at predetermined intervals, said second anode having a first cylindrical portion at a panel side and a second cylindrical portion at a cathode side, said first cylindrical portion having a larger inner diameter than an inner diameter of said second cylindrical portion, said the focus electrode having a panel side cylindrical portion with an inner diameter D1 and a length L1, an intermediate cylindrical portion with an inner diameter D3 and a length L3, a cathode side cylindrical portion with an inner diameter D2 and a length L2, said inner diameters D1, D2, and D3 being different from each other, and said focus electrode having a first funnel like connecting portion between said panel side cylindrical portion and said intermediate cylindrical portion and a second funnel like connecting portion between said intermediate cylindrical portion and said cathode side cylindrical portion.

12. A projection type cathode ray tube according to claim 11, wherein said second anode has a connecting portion between said first cylindrical portion and said second cylindrical portion, wherein connecting position between said first funnel like connecting portion and said intermediate cylindrical portion of said focus electrode is nearer to said panel as compared to said connecting portion of said second anode.

13. A projection type cathode ray tube according to claim 12, wherein a length along said tube axial direction of said second funnel like connecting portion is substantially larger than a thickness of a cylindrical wall of said focus electrode.

14. A projection type cathode ray tube according to claim 12, wherein a cross-section along said tube axial direction of said second funnel like connecting portion of said focus electrode has a tapered line beveled to a wall of said intermediate cylindrical portion and a wall of said cathode side cylindrical portion.

15. A projection type cathode ray tube according to claim 12, wherein said inner diameters D1, D2, and D3 satisfies D1>D3>D2.

16. A projection type cathode ray tube comprising:

a panel; and an electron gun;

wherein said electron gun has a plurality of electrodes including a cathode, a control electrode, an accelerating electrode, a first anode, a focus electrode and a second anode, which electrodes are arranged in a tube axial direction at predetermined intervals, and said second anode having a first cylindrical portion at said panel side and a second cylindrical portion at a cathode side, said first cylindrical portion having a larger inner dinner diameter than an inner diameter of said second cylindrical portion, said focus electrode having a panel side cylindrical portion with an inner diameter D1 and a length L1, an intermediate cylindrical portion with an inner diameter D3 and a length L3, a cathode side cylindrical portion with an inner diameter D2 and a length L2, said inner diameters D1, D2, and D3 being different from each other, wherein said focus electrode having a first funnel like connecting portion between said panel side cylindrical portion and said intermediate cylindrical portion, and said focus electrode having a gap in said cathode side cylindrical portion in said tube axial direction.

17. A projection type cathode ray tube according to claim 16, wherein said focus electrode is divided into two electrodes at said cathode side cylindrical portion, and said two electrodes are electrically connected.

18. A projection type cathode ray tube according to claim 16, wherein said second anode has a connecting portion between said first cylindrical portion and said second cylindrical portion, and a connecting position between said first funnel like connecting portion and said intermediate cylindrical portion of said focus electrode is nearer to said panel as compared to said connecting portion of said second anode.

19. A projection type cathode ray tube according to claim 16, wherein a length along said tube axial direction of said first funnel like connecting portion is substantially larger than a thickness of a cylindrical wall of said focus electrode.

20. A projection type cathode ray tube according to claim 16, wherein a cross-section along said tube axial direction of said first funnel like connecting portion of said focus electrode has a tapered line beveled to a wall of said panel side cylindrical portion and a wall of said intermediate cylindrical portion.

21. A projection type cathode ray tube according to claim 16, wherein said inner diameters D1, D2, and D3 satisfies D1>D3>D2.

22. A projection type cathode ray tube according to claim 16, wherein said focus electrode has a second funnel like connecting portion between said intermediate cylindrical portion and said cathode side cylindrical portion.

23. A projection type cathode ray tube according to claim 22, wherein said second anode has a connecting portion between said first cylindrical portion and said second cylindrical portion, and a connecting position between said first funnel like connecting portion and said intermediate cylindrical portion of said focus electrode is nearer to said as panel compared to said connecting portion of said second anode.

24. A projection type cathode ray tube according to claim 23, wherein a length along said tube axial direction of said second funnel like connecting portion is substantially larger than a thickness of a cylindrical wall of said focus electrode.

25. A projection type cathode ray tube according to claim 23, wherein a cross section along said tube axial direction of said second funnel like connecting portion of said focus electrode has a tapered line beveled to a wall of said intermediate cylindrical portion and a wall of said cathode side cylindrical portion.

26. A projection type cathode ray tube according to claim 23, wherein said inner diameters D1, D2, and D3 satisfies D1>D3>D2.

* * * * *